US007708534B2

(12) United States Patent
Parmeter et al.

(10) Patent No.: US 7,708,534 B2
(45) Date of Patent: May 4, 2010

(54) PRESSURE EQUALIZER IN THRUST CHAMBER ELECTRICAL SUBMERSIBLE PUMP ASSEMBLY HAVING DUAL PRESSURE BARRIERS

(75) Inventors: Larry J. Parmeter, Broken Arrow, OK (US); Arturo Luis Poretti, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 232 days.

(21) Appl. No.: 11/774,439

(22) Filed: Jul. 6, 2007

(65) Prior Publication Data

US 2009/0010773 A1 Jan. 8, 2009

(51) Int. Cl.
*F04B 35/04* (2006.01)

(52) U.S. Cl. ..... 417/423.3; 417/365; 417/372; 417/414; 166/105

(58) Field of Classification Search ..... 417/423.3, 417/365, 372, 414; 166/66.4, 105, 68; 310/87
See application file for complete search history.

(56) References Cited

U.S. PATENT DOCUMENTS 3,671,786 A 6/1972 Jones
4,421,999 A * 12/1983 Beavers et al. ..... 310/87
4,436,488 A 3/1984 Witten
4,477,235 A * 10/1984 Gilmer et al. ..... 417/414
4,583,923 A * 4/1986 James ..... 417/414
5,842,521 A 12/1998 Tetzlaff et al.
6,322,331 B1 11/2001 Swatek et al.
6,615,926 B2 9/2003 Hester et al.
6,688,860 B2 * 2/2004 Du et al. ..... 417/423.11
6,868,912 B2 3/2005 Proctor

* cited by examiner

*Primary Examiner*—Devon C Kramer
*Assistant Examiner*—Todd D Jacobs
(74) *Attorney, Agent, or Firm*—Bracewell & Giuliani LLP

(57) ABSTRACT

A well pump assembly has a rotary pump with an electrical motor that contains a motor lubricant. A thrust chamber is mounted between the motor and the pump, the thrust chamber containing a thrust chamber lubricant. Seals prevent the entry of thrust chamber lubricant into the motor chamber. A pressure equalizing chamber is mounted to the motor for admitting well fluid. A first pressure barrier in the equalizing chamber equalizes the pressure of the thrust chamber lubricant with that of the well fluid. A second pressure barrier contained within the first pressure barrier equalizes the pressure of the motor lubricant with thrust chamber lubricant.

21 Claims, 6 Drawing Sheets

PRESSURE EQUALIZER IN THRUST CHAMBER ELECTRICAL SUBMERSIBLE PUMP ASSEMBLY HAVING DUAL PRESSURE BARRIERS

FIELD OF THE INVENTION

This invention relates in general to submersible well pump assemblies, and in particular to a pressure equalizer that reduces the pressure differential between lubricant in the motor and the exterior hydrostatic pressure in the well bore.

BACKGROUND OF THE INVENTION

Electrical submersible pumps are used to convey large volumes of fluid from wells typically for hydrocarbon production. Normally an electrical submersible pump assembly will comprise a rotary pump and a downhole electrical motor. The rotary pump may be a centrifugal pump made up of a large number of centrifugal stages of impellers and diffusers. Alternately, a progressing cavity pump may be utilized in some circumstances.

The motor is filled with a dielectric motor oil or lubricant. The motor oil expands when the temperature rises, which normally occurs when lowering a pump into a well. Also, heat of the motor during operation causes the temperature to rise. The expansion of the oil could exceed the volume capacity of the motor, causing a leak. To avoid this occurrence, a seal section is connected between the motor and the pump. The seal section has an inlet for admitting well fluid and a flexible barrier to separate the well fluid from the lubricant and equalize the pressure between the lubricant contained in the motor and the well bore fluid. The seal section has a vent that allows the motor to vent excess oil into the well environment if the volume of oil increases beyond the volume capacity of the assembly.

Also, commonly the seal section will have a thrust bearing to take thrust load from the pump above. Conventional seal sections thus have four basic functions: a) equalizing pressure between the well bore and inside the motor; b) providing a reservoir for the motor oil; c) compensating for the expansion of oil due to temperature increase; and d) taking the thrust load from the pump above.

One problem with existing seal sections is that if a leak occurs, well fluid will enter the motor and cause an electrical short, thus destroying the equipment. To avoid this occurrence, in some cases, several seal sections are coupled together, with each operating independently of the other. In that arrangement, if the top seal section should leak and fail, the underlying seal sections will continue to protect the motor. Redundant seal sections are costly, however, and only add an additional amount of time before failure eventually occurs. Often, if the top seal section fails, vibration and leakage will also cause failure out of the other seal sections in fairly short order.

DETAILED DESCRIPTION OF THE INVENTION

Figure 1:
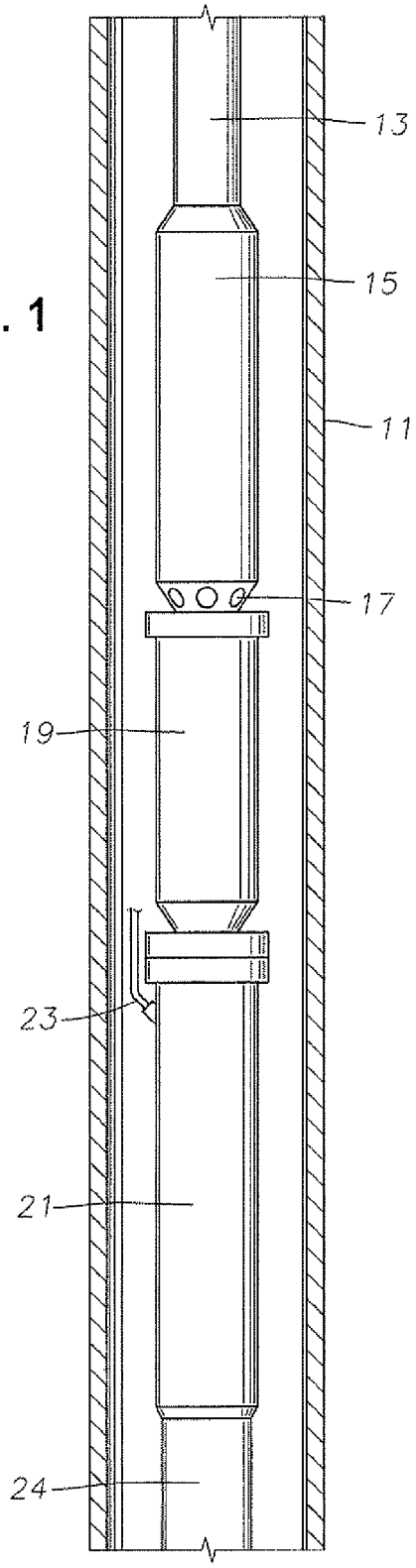
FIG. 1 is a sectional, partly schematic view illustrating a pump assembly constructed in accordance with this invention.
Figure 4:
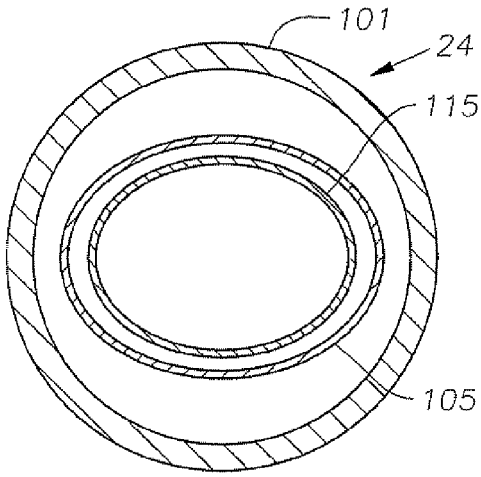
FIG. 4 is a sectional view of the equalizing chamber of FIG. 1, shown along the line 4-4 of FIG. 2C.

Referring to FIG. 1, a well is illustrated as having a casing 11. A string of production tubing 13 is lowered into casing 11. A rotary pump 15 is attached to the lower end of tubing 13 for delivering well fluid up tubing 13. Pump 15 is typically a centrifugal pump having a large number of stages, each stage having an impeller and a diffuser. Alternately, pump 15 can be other types, such as a progressive cavity pump. Pump 15 has an intake 17 that draws well fluid into pump 15.

A thrust unit 19 is connected to the lower end of pump 15. An electrical motor 21 is secured to the lower end of thrust unit 19. Motor 21 is normally a three-phase electrical motor supplied with power from a power cable 23 extending down from the surface. A pressure equalizing assembly 24 is secured to the lower end of motor 21.

Figure 2A:
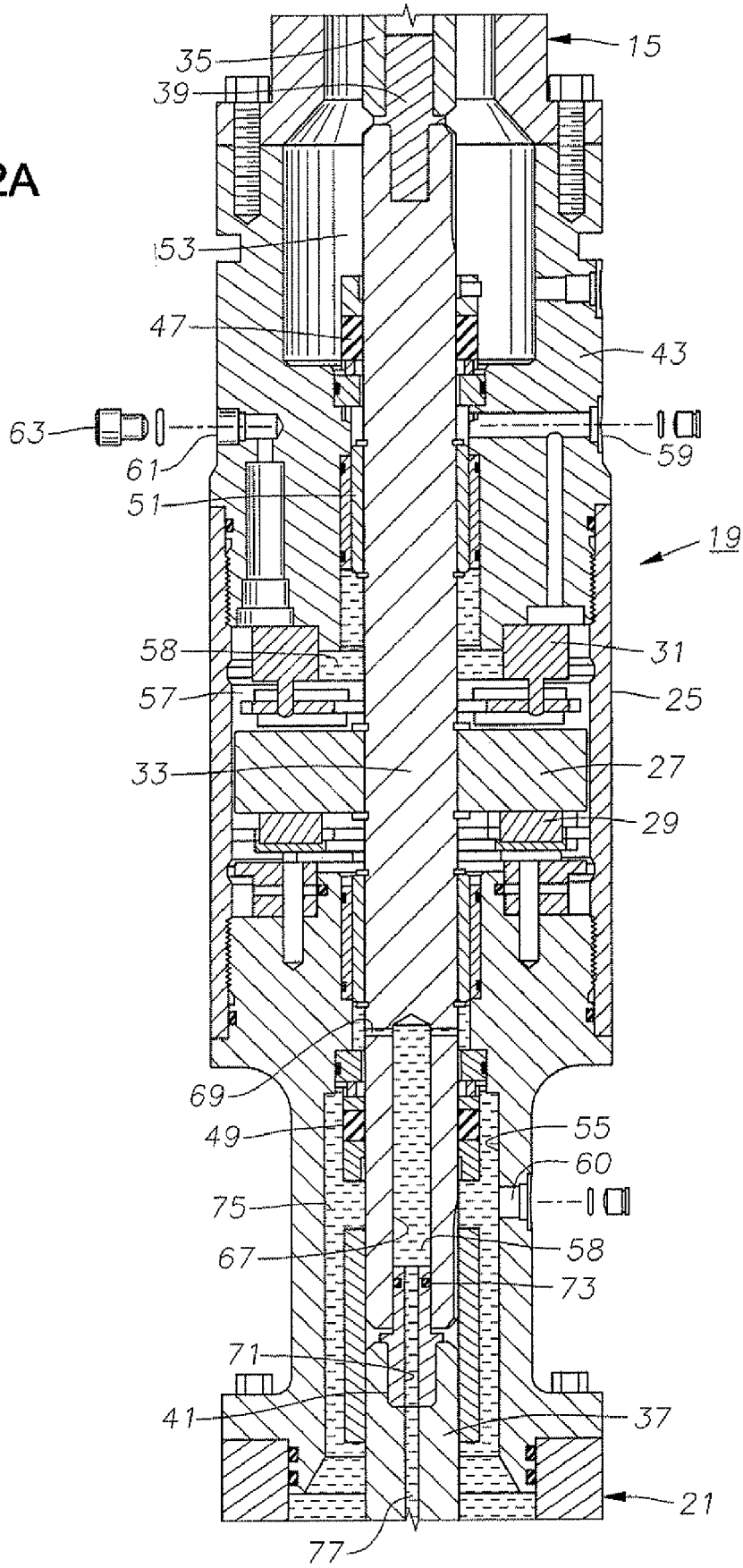
FIG. 2A is a sectional view of a thrust chamber employed in the pump assembly of FIG. 1.

Referring to FIG. 2A, thrust unit 19 has a housing 25. A conventional thrust bearing assembly for absorbing thrust from pump 15 (FIG. 1) is contained within housing 25. The thrust bearing assembly will normally have a rotating bearing member or runner 27 and a stationary downthrust base 29. Since upthrust can occur with pump 15 (FIG. 1), the thrust bearing assembly may also have an upthrust base 31 mounted above thrust runner 27. Thrust runner 27 is mounted to a thrust chamber shaft 33 for rotation therewith.

Thrust chamber shaft 33 is coupled to the lower end of pump shaft 35. The lower end of thrust chamber shaft 33 is coupled to motor shaft 37. A connector 39 between pump shaft 35 and thrust chamber shaft 33 transmits torque and compression and optionally tension. A connector 41 similarly serves to transmit torque, compression and optionally tension between motor shaft 37 and thrust chamber shaft 33.

Thrust unit 19 has a head section 43 that secures to the upper end of housing 25. Also, a base section 45 secures to the lower end of thrust unit housing 25. An upper seal assembly 47 forms a seal around thrust chamber shaft 33 to prevent the entry of well fluid from cavity 53 into thrust unit housing 25. Similarly, a lower seal assembly 49 is located within base section 45 for sealing around thrust chamber shaft 33. A set of bushings 51 within head section 43 and within base section 45 provide radial stability for shaft 33 but do not form seals.

Upper cavity 53 within thrust unit head section 43 will be filled with well fluid during operation. A lower cavity 55 surrounds lower seal assembly 49. The various spaces between upper and lower seals 47, 49 may be considered part of a thrust chamber 57 containing thrust chamber lubricant 58. Thrust chamber lubricant 58 serves to lubricate the bearing components 27, 29, 31 and 51. Thrust unit 19 has a fill port 59 for filling thrust chamber 57 with thrust chamber lubricant 58. The filling may be conventional, optionally using a vacuum pump to first evacuate air. Additionally, a port having a check valve 63 allows excess thrust chamber lubricant 58 to be expelled to the exterior during filling and during operation. In this example, check valve 63 is positioned at the upper end of thrust chamber 57 close to upper seal assembly 47.

Figure 3:
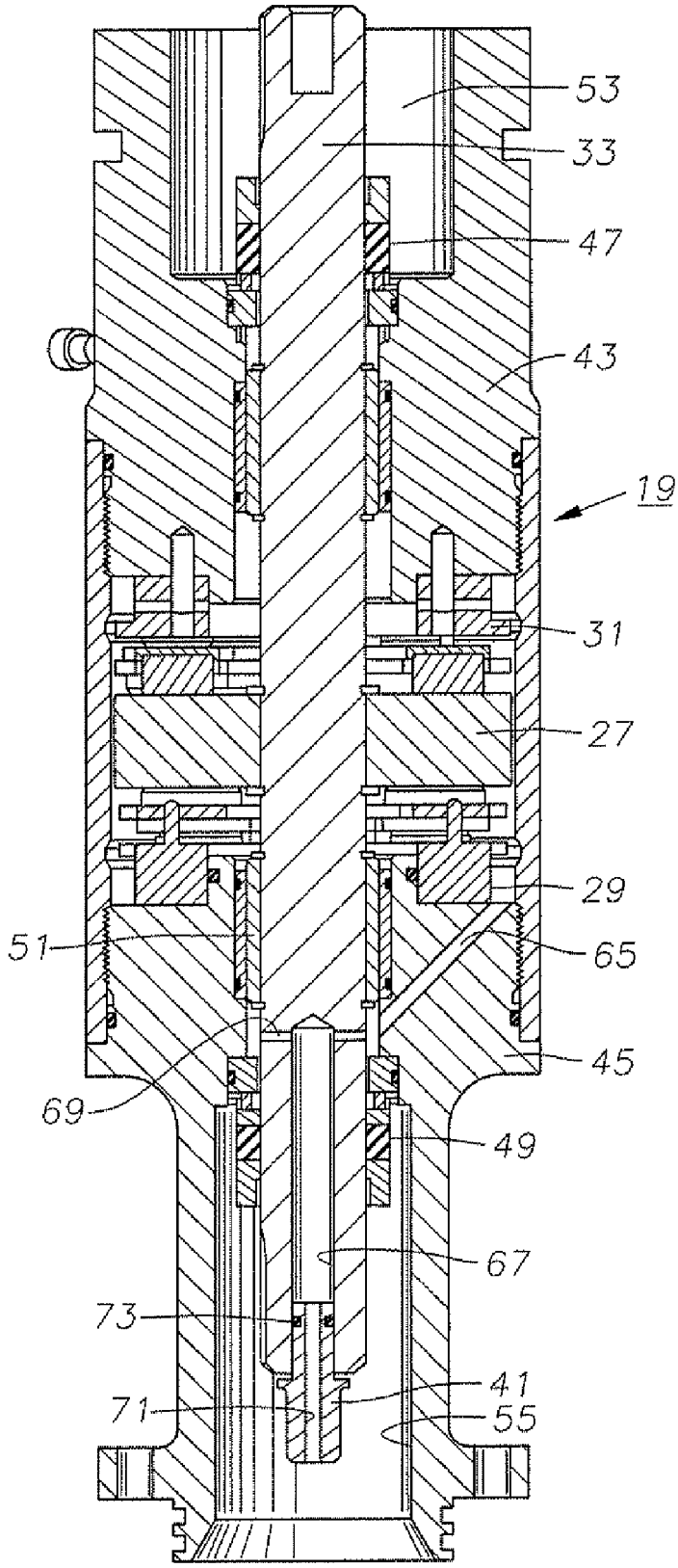
FIG. 3 is a sectional view similar to FIG. 2A, but shown in a different sectional plane.

FIG. 3, which shows thrust unit 19 taken from a different sectional plane than FIG. 2A, illustrates a passage 65 that communicates thrust chamber lubricant 58 from the thrust bearing area to a point just above lower seal 49. Thrust chamber shaft 33 has a passage 67 that extends axially upward within shaft 33 from the bottom of shaft 33 to a point a short distance above lower seal 49. Cross-drilled ports 69 extend through shaft 33 near the upper end of passage 67 just above lower seal 49. Passage 65 communicates thrust chamber lubricant 58 to shaft axial passage 67 via ports 69. An axial passage 71 extends through lower connector 41 for communication with thrust chamber shaft passage 67. Connector 41 has seals 73 that prevent any leakage of thrust chamber lubricant 58 to cavity 55.

Cavity 55 is filled with a motor lubricant 75, as illustrated in FIG. 2A. Motor lubricant 75 is a dielectric oil that is contained within motor 21 (FIG. 1). Motor lubricant 75 and thrust chamber lubricant 58 may be the same type of lubricant. Alternately, they may have different properties for their different functions. A motor shaft passage 77 extends axially through motor shaft 37 from the lower end to the upper end. Thrust chamber lubricant 58 is able to migrate downward and upward through motor shaft passage 77.

Figure 2B:
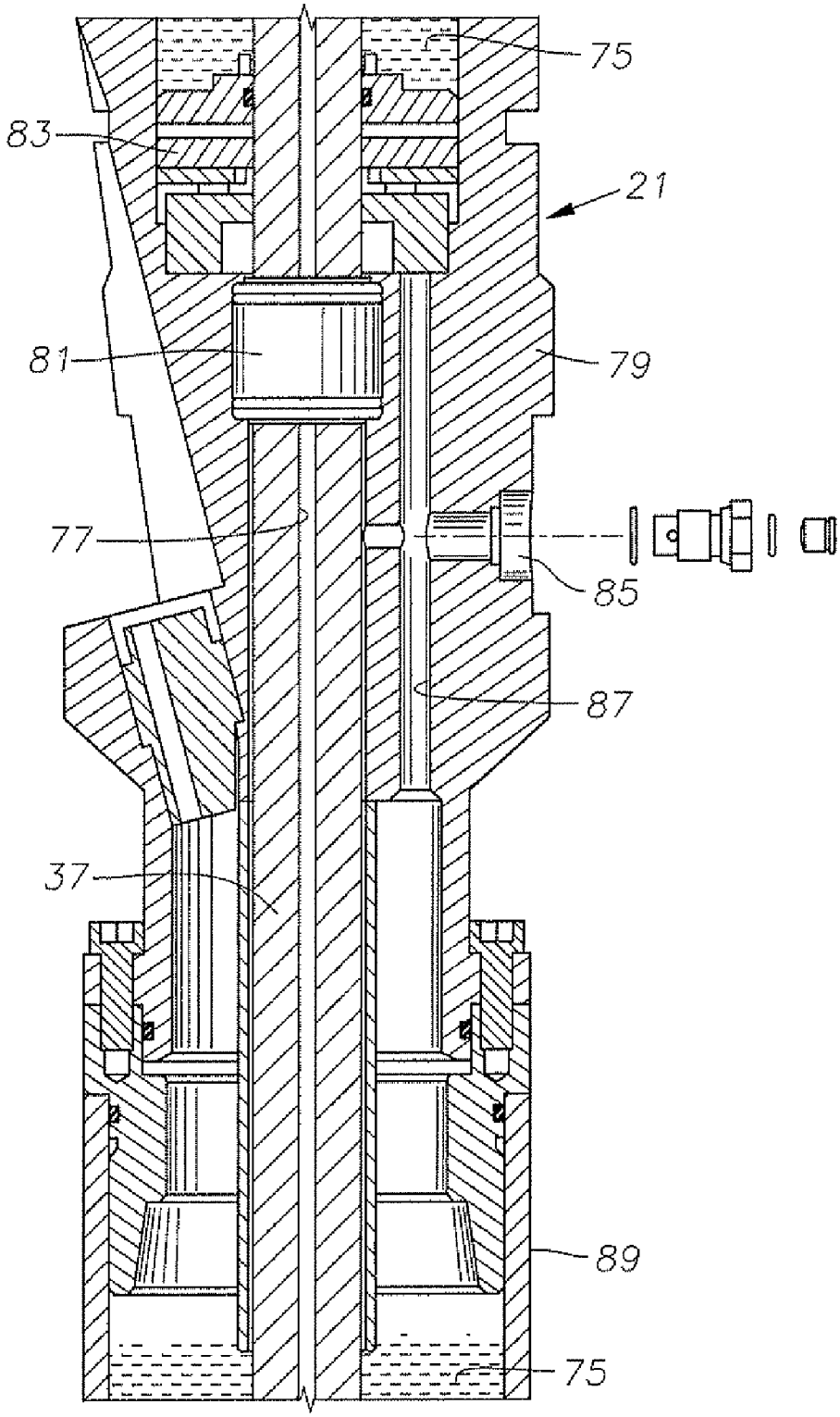
FIG. 2B is a sectional view of the top of the motor of the assembly of FIG. 1.

Referring to FIG. 2B, a motor head 79 is shown. Head 79 has bushings 81 for radially stabilizing motor shaft 37. Motor head 79 may also optionally have a motor thrust bearing 83 to absorb downthrust on motor shaft 37 due to the weight of the rotor and shaft 37 of motor 21. A fill port 85 is shown in FIG. 2B for use in filling motor 21 with motor lubricant 75. The filling is handled conventionally. Fill port 85 joins a passage 87 that extends from the chamber containing motor thrust bearing 83. Motor lubricant 75 located within passage 87 communicates into thrust unit lower cavity 55 (FIG. 2A), but is sealed from thrust chamber lubricant 58 by seals 73.

Figure 2C:
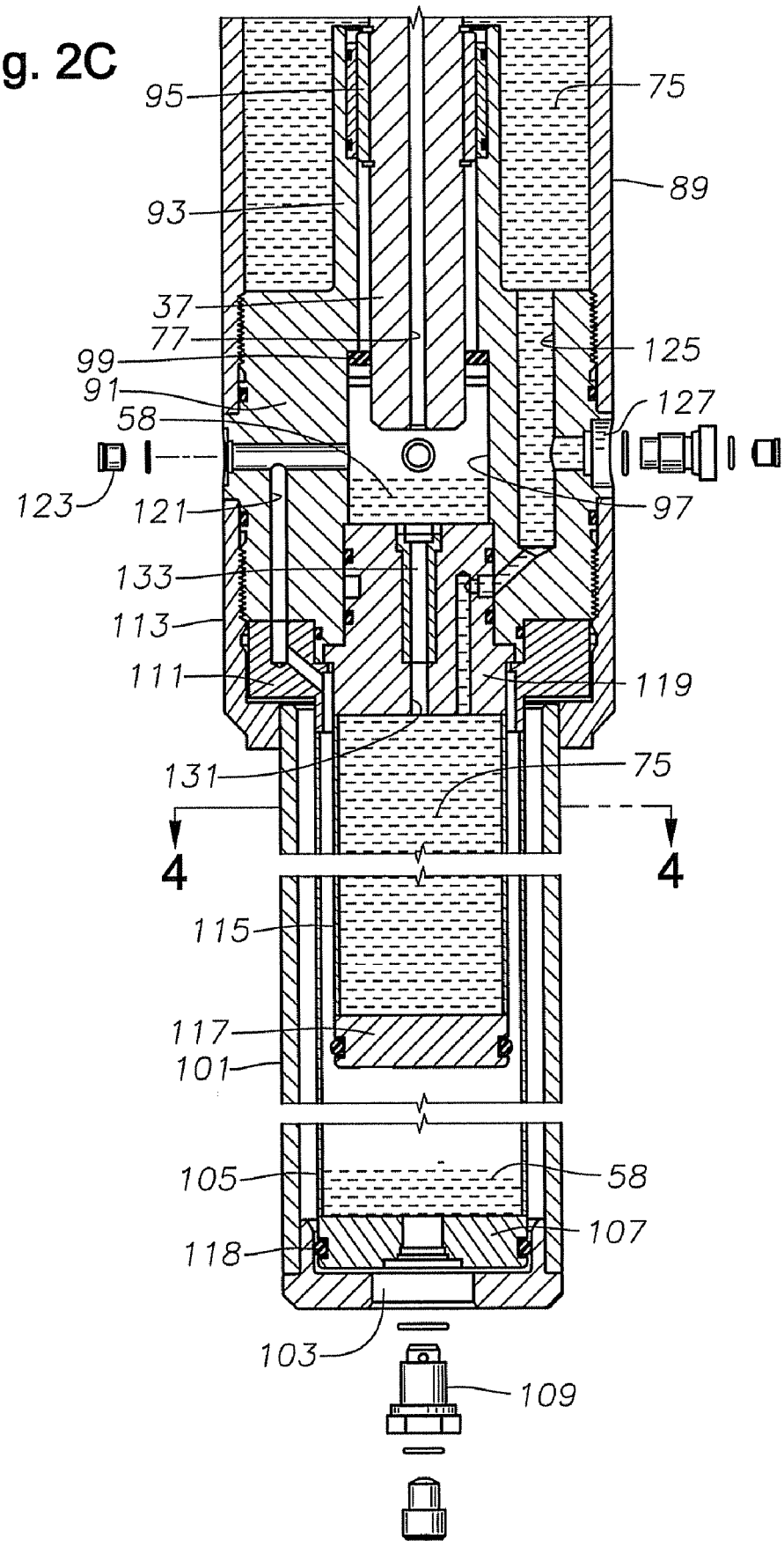
FIG. 2C is a sectional view of the bottom of the motor of FIG. 1, and also showing an equalizing chamber.

Referring still to FIG. 2B, motor 21 has a housing 89, the lower portion of which is shown in FIG. 2C. Housing 89 contains electrical components of motor 21, such as the rotor and the stator, which includes windings. Referring to FIG. 2C, an adaptor 91 secures to the lower end of motor housing 89, such as by threads as shown. Adapter 91 has a tubular neck 93 extending upward. A set of radial bushings 95 provides support for the lower end of motor shaft 37. Adapter 91 has a central cavity 97 into which the lower end of motor shaft 37 extends. Cavity 97 will be filled with thrust chamber lubricant 58 via passage 77 in motor shaft 37. A lip seal 99 seals around the lower portion of motor shaft 37 to prevent thrust chamber lubricant 58 from leaking past bushings 95 into motor housing 89.

In this example, pressure equalizer 24 is a separate unit attached to the lower end of motor housing 89, but it could be incorporated within motor housing 89. Equalizer 24 includes a housing 101 that has an inlet port 103 for admitting well fluid. In this embodiment, inlet port 103 is located on the bottom of housing 101, but it could be located elsewhere. The equalizing components include an outer flexible barrier 105 located within housing 101. Outer barrier 105 in this example is a thin-walled metal container. Outer barrier 105 has a bottom 107 having a fill port that receives a plug 109. Outer barrier 105 has a rim 111 on its upper end that joins outer barrier 105 to adapter 91. Rim 111 is retained by a collar 113 that has a shoulder on which rim 111 rests and internal threads that secure to external threads on adapter 91.

An inner barrier 115 is located within outer barrier 105 in this example. Inner barrier 115 has the same configuration but a smaller diameter as well as length. Inner barrier 115 also has a closed bottom 117. Bumpers 118 may be located on the bottoms 107, 117 to avoid vibration damage. In this example, outer and inner barriers 105, 115 are generally elliptical in shape between the upper and lower ends. This shape facilitates the walls of outer and inner barriers 105, 115 flexing radially. Barriers 105, 115 collapse and expand radially in response to pressure changes.

Inner barrier 115 is retained by an inner barrier adapter 119 at its upper end. Inner barrier adapter 119 is secured into the lower end of cavity 97 of adapter 91. Seals on the exterior of inner barrier adapter 119 prevent thrust bearing lubricant 58 from leaking around the sides of inner barrier adapter 119 into inner barrier 115. A passage 121 extends from cavity 97 through adapter 91, rim 111 and into outer barrier 105 at a point between inner barrier 115 and outer barrier 105. A plug 123 blocks passage 121 from the exterior.

A motor lubricant passage 125 extends from the interior of motor housing 89 downward in through adapter 119 to the interior of inner barrier 115. A fill port 127 communicates with motor lubricant passage 125 for filling motor housing 89 with motor lubricant 75. During filling, fill port 127 is used in combination with another port at the upper end of motor 21, such as port 85 (FIG. 2B) to determine when the spaces for motor lubricant 75 are full. A vent passage 131 extends from the lower end to the upper end of adapter 119 in communication with cavity 97. Vent port 131 contains one or more check valves 133 that allow the upward flow of motor lubricant 75 if the pressure differential is sufficient to open check valves 133, Check valves 133, however, will not allow any flow of thrust chamber lubricant 58 downward through vent port 131.

In operation, motor 21 and inner barrier 115 will be filled with motor lubricant 75. Thrust unit 19 and outer barrier 105 will be filled with thrust chamber lubricant 58. Thrust chamber lubricant 58 will also occupy passage 121, cavity 97 and motor shaft passage 77 (FIG. 2C). Motor lubricant 75 will be located in motor 21 and thrust unit cavity 55 (FIG. 2A). The operator lowers the pump assembly into the well on tubing 13. The well temperature will cause motor lubricant 75 and thrust chamber lubricant 58 to expand. When the operator begins supplying power to motor 21, heat from the motor further increases the temperature of the pump assembly, and causes more expansion of thrust chamber lubricant 58 and motor lubricant 75. When the lubricant spaces are full, continued thermal expansion increases the pressure differential of thrust chamber lubricant 58 and motor lubricant 75 over the wellbore pressure. When the pressure differential reaches a selected level, excess motor lubricant 75 will vent through port 131 (FIG. 2C) into cavity 97, thus commingling with thrust chamber lubricant 58. Excess thrust chamber lubricant 58 will also vent, not only to accommodate the additional motor lubricant 75 that was vented into cavity 97, but also because of the expansion of thrust chamber lubricant 58. Thrust chamber lubricant 58 vents to the wellbore through check valve 63 shown in FIG. 2A.

The hydrostatic pressure of the well fluid will be communicated to thrust chamber lubricant 58 and motor lubricant 75 via port 103 (FIG. 2C). The well fluid will locate on the exterior of outer barrier 105. The pressure of the well fluid will act on the flexible outer barrier 105 to increase the pressure of thrust chamber lubricant 58 to approximately that of the wellbore. The increased pressure in outer barrier 105 acts on inner barrier 115 in a similar manner, causing the pressure in inner barrier 115 to increase. During operation, the internal pressures of thrust chamber lubricant 58 and motor lubricant 75 will be approximately the same and substantially equal to the hydrostatic pressure of the well fluid in the wellbore.

When motor 21 is turned off, motor 21 and thrust unit 19 will cool, allowing the lubricants 58 and 75 to shrink in volume. The original volume of lubricant in both the thrust unit 19 and motor 21 is less now because some was vented during the initial startup. The decrease in volume of lubricants 58, 75 could cause a vacuum to occur inside motor 21 and thrust unit 19. If a vacuum were allowed to persist, well fluid could be pulled past the O-rings and mechanical seals 47, 49, which could contaminate motor 21. The flexibility and elliptical shape, however, of the inner and outer barriers 115, 105 prevent this potential problem from occurring. A vacuum produced during cool-down causes inner and outer barriers 105, 115 to collapse to a lesser volume that accounts for the amount of lubricant 75, 58 previously expelled to the wellbore. This collapsing will re-equalize the negative pressure differential. When motor 21 is started again, barriers 115, 105 will expand again as lubricants 75 and 58 expand. In most cases, motor 21 and thrust unit 19 will resume a previous operating temperature, therefore no additional lubricant will be discharged through the check valves.

Figure 5:
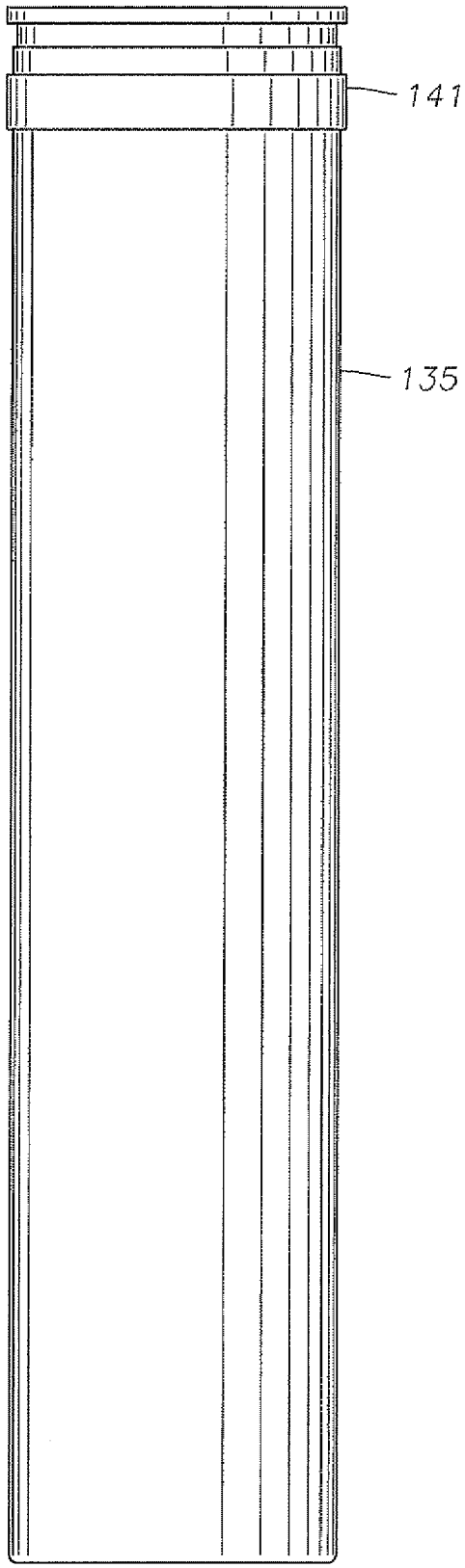
FIG. 5 is a side elevational view of an alternate embodiment of a pressure equalizing barrier.
Figure 6:
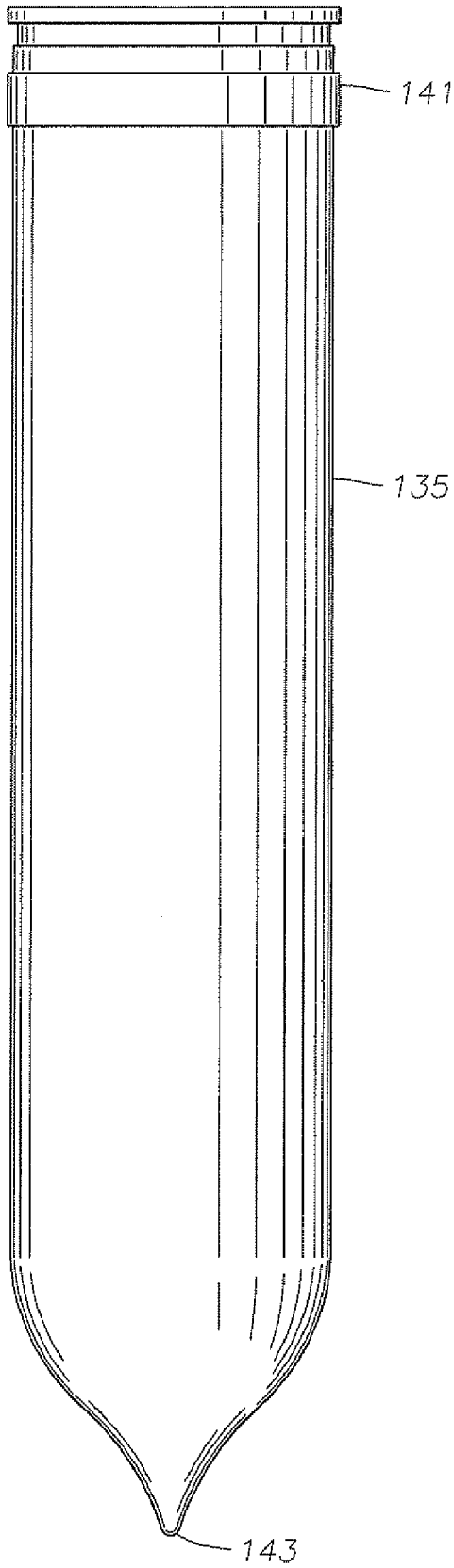
FIG. 6 is another side elevational view of the barrier of FIG. 5.

FIGS. 5 and 6 illustrate an alternate embodiment for at least one or both of the thin-walled metal barriers 105, 115. In this embodiment, the barrier comprises a flexible bag 135, which is constructed from a strong engineering fabric, such as Kevlar or woven carbon fiber. Bag 135 is impervious, which is achieved by impregnation of the fabric with high temperature elastomeric materials, such as fluoroelastomers or fluoropolymers. These compounds penetrate and embed within the internal fibers of the fabric, rather than being separate layers or coatings over the fabric. The impermeability of the fabric at high temperatures is retained regardless of any decreased mechanical properties of the impervious material used for impregnation. The strength of bag 135 is provided by the fabric, while the impervious properties are conferred by the infused fluoroelastomer or fluoropolymer compounds.

Bag 135 has a mouth that will clamp to outer rim 111 (FIG. 2C) and a closed lower end 143, which may be a seam as shown in FIG. 6 or a spherical or flat bottom. Bag 135 could be located within the metal-walled outer barrier 105 (FIG. 2C), or bag 135 could be located within an elastomeric and fabric bag of similar construction. Also, bag 135 could be utilized alone, without another bag, if one chose to use the same lubricant in thrust unit 19 (FIG. 1) and motor 21 and to allow the lubricant to commingle throughout thrust unit 19 and motor 21.

The invention has significant advantages. If the thrust unit should leak, the thrust bearings and radial bushings will continue to operate in well fluid. Additionally, since the thrust chamber lubricant is completely isolated from entry into the spaces for the motor lubricant, the motor will not be contaminated even if the thrust unit develops a leak. This assembly will function at extreme temperatures and is only limited by the capabilities of the lubricant and the insulation of the electrical motor.

While the invention has been shown in only two of its forms, it should be apparent to those skilled in the art that it is not so limited but is susceptible to various changes without departing from the scope of the invention. For example, rather than thin wall metal barriers and elastomeric/fabric bladders, bellows with accordion sidewalls could be employed.

We claim:

1. A well pump assembly, comprising:

a rotary pump;

an electric motor for rotating the pump, the motor having a motor chamber containing a motor lubricant;

a thrust chamber mounted between the motor and the pump, the thrust chamber containing a thrust chamber lubricant;

a thrust bearing mounted in the thrust chamber for absorbing thrust imposed by operation of the pump;

at least one seal for preventing entry of thrust chamber lubricant into the motor chamber;

a pressure equalizing housing mounted to the motor and having a thrust chamber lubricant passage that admits thrust chamber lubricant from the thrust chamber, a motor lubricant passage that admits motor lubricant from the motor, and a well fluid inlet for admitting well fluid;

a seal below the thrust bearing that seals between the thrust chamber lubricant and the motor lubricant;

a first barrier in the housing having one side in contact with thrust chamber lubricant in the housing and an opposite side adapted to be contacted by well fluid in the housing, the first barrier being movable relative to the housing for reducing a pressure differential between the well fluid in the housing and the thrust chamber lubricant; and a second barrier in the housing having one side in contact with thrust chamber lubricant in the housing and an opposite side in contact with motor lubricant in the housing, the second barrier being movable relative to the housing for reducing a pressure differential between the thrust chamber lubricant and the motor lubricant.

2. The assembly according to claim 1, wherein each of the barriers comprises a container having a movable wall; and the second barrier is located within the first barrier, and the movable walls are spaced apart from each other.

3. The assembly according to claim 1, wherein:

the pressure equalizing housing is mounted to a lower end of the motor; and the motor has a drive shaft, and the thrust chamber lubricant a passage extends within and along an axis of the drive shaft.

4. The assembly according to claim 1, wherein each of the barriers comprises a container having flexible metal walls.

5. The assembly according to claim 3, wherein a portion of each of the containers is elliptical in cross-section.

6. The assembly according to claim 1, wherein at least one of the barriers comprises a fabric of woven carbon fiber impregnated with a fluoropolymer material to make the woven carbon fiber impervious.

7. The assembly according to claim 1, further comprising an excess motor lubricant passage leading from a portion of the assembly containing motor lubricant to a portion of the assembly containing thrust chamber lubricant, the excess motor lubricant passage having a check valve for allowing motor lubricant to flow into the portion of the assembly containing thrust chamber lubricant if motor lubricant pressure sufficiently exceeds thrust chamber lubricant pressure, but preventing flow in a reverse direction.

8. The assembly according to claim 1, further comprising an excess thrust chamber lubricant passage leading from a portion of the assembly containing thrust chamber lubricant to the exterior of the assembly for expelling excess thrust chamber lubricant if thrust chamber lubricant pressure sufficiently exceeds exterior well fluid pressure.

9. A well pump assembly, comprising:

a rotary pump having a pump shaft;

an electric motor having a motor drive shaft;

a thrust chamber having a thrust chamber shaft coupled on its lower end to the motor drive shaft and its upper end to the pump shaft, such that when energized, the motor rotates the motor shaft, which in turn rotates the thrust chamber shaft and causes the pump shaft to rotate;

a thrust bearing mounted to the thrust chamber shaft for absorbing thrust imposed on the pump shaft;

a motor lubricant contained in the motor;

a thrust chamber lubricant contained in the thrust chamber and separated from communication with the motor lubricant;

a pressure equalizing chamber mounted to a lower end of the motor and having an inlet for admitting well fluid;

an outer flexible barrier in the pressure equalizing chamber having an outer side for exposure to well fluid and an inner side in fluid communication with the thrust chamber lubricant; and an inner flexible barrier within the outer flexible barrier and having an inner side in fluid communication with the motor lubricant, such that an increase in well fluid pressure causes the outer flexible barrier to constrict to increase the pressure of the thrust chamber lubricant, and the constriction of the outer flexible barrier causes the inner flexible barrier to constrict to increase the pressure of the motor lubricant.

10. The assembly according to claim 9, further comprising:

a thrust chamber lubricant passage extending axially through the motor shaft to communicate thrust chamber lubricant to the inner side of the outer flexible barrier.

11. The assembly according to claim 9, wherein each of the barriers comprises a container having metal walls that flex radially inward and radially outward, relative to an axis of each container.

12. The assembly according to claim 11, wherein a portion of each of the containers is elliptical in cross-section.

13. The assembly according to claim 9, further comprising an excess motor lubricant passage leading from the inner flexible barrier to the outer flexible barrier for expelling excess motor lubricant from the inner flexible barrier to the outer flexible barrier.

14. The assembly according to claim 9, further comprising a check valve in the excess motor lubricant passage for blocking flow of thrust chamber lubricant into the inner flexible barrier.

15. The assembly according to claim 14, further comprising an excess thrust chamber lubricant passage leading from the thrust chamber to the exterior of the thrust chamber for expelling excess thrust chamber lubricant to the exterior.

16. The assembly according to claim 9, further comprising:

a lower adapter secured to the lower end of the motor and having a lower adapter chamber;

wherein a lower end of the motor drive shaft t6rminates in the lower adapter chamber, and upper ends of the outer and inner flexible barriers are sealingly secured to a lower end of the lower adapter;

a thrust chamber passage extending through a portion of the lower adapter from the lower adapter chamber to the inner side of the outer flexible barrier; and a motor lubricant passage extending through a portion of the lower adapter from an interior of the motor to the inner side of the inner flexible barrier.

17. The assembly according to claim 9, wherein at least one of the barriers comprises a container formed of a fabric of woven carbon fiber impregnated with a fluoropolymer material to make the woven carbon fiber impervious.

18. A well pump assembly, comprising:

a rotary pump having a pump shaft;

an electric motor having a motor drive shaft;

a thrust chamber having a thrust chamber shaft coupled on its lower end to the motor drive shaft and its upper end to the pump shaft, such that when energized, the motor rotates the motor shaft, which in turn rotates the thrust chamber shaft and causes the pump shaft to rotate;

a thrust bearing mounted to the thrust chamber shaft for absorbing thrust imposed on the pump shaft;

a motor lubricant contained in the motor;

a thrust chamber lubricant contained in the thrust chamber;

a seal below the thrust bearing that separates the thrust chamber lubricant from communication with the motor lubricant;

a pressure equalizing housing mounted to the motor and having a well fluid inlet for admitting well fluid into the housing;

an outer flexible barrier in the housing having an outer side for exposure to well fluid and an inner side in fluid communication with the thrust chamber lubricant; and an inner flexible barrier within the outer flexible barrier, having an outer side in contact with the thrust chamber lubricant within the outer flexible barrier and having an inner side in fluid communication with the motor lubricant, such that an increase in well fluid pressure causes the outer flexible barrier to constrict to increase the pressure of the thrust chamber lubricant, and the constriction of the outer flexible barrier causes the inner flexible barrier to constrict to increase the pressure of the motor lubricant.

19. The assembly according to claim 18, further comprising:

a thrust chamber lubricant passage extending axially through the motor shaft to communicate the thrust chamber lubricant to the inner side of the outer flexible barrier.

20. The assembly according to claim 18, wherein each of the barriers comprises a container having metal walls that flex radially inward and radially outward, relative to an axis of each container.

21. The assembly according to claim 18, wherein a portion of each of the containers is elliptical in cross-section.

* * * * *

UNITED STATES PATENT AND TRADEMARK OFFICE

CERTIFICATE OF CORRECTION

PATENT NO. : 7,708,534 B2
APPLICATION NO. : 11/774439
DATED : May 4, 2010
INVENTOR(S) : Larry A. Parmeter et al.

It is certified that error appears in the above-identified patent and that said Letters Patent is hereby corrected as shown below:

IN THE CLAIMS:

Column 6, line 29, delete "a" before "passage"

Signed and Sealed this

Thirty-first Day of August, 2010

David J. Kappos

David J. Kappos
*Director of the United States Patent and Trademark Office*